US005169329A

United States Patent [19]

Taguchi

[11] Patent Number: 5,169,329

[45] Date of Patent: Dec. 8, 1992

[54] CONNECTOR AND DETECTOR FOR DETECTING FITTED CONDITION BETWEEN CONNECTOR ELEMENTS

[75] Inventor: Naoto Taguchi, Shizuoka, Japan

[73] Assignee: Yazaki Corporation, Japan

[21] Appl. No.: 797,991

[22] Filed: Nov. 26, 1991

[30] Foreign Application Priority Data

Nov. 28, 1990 [JP] Japan ..... 2-322564

[51] Int. Cl.[5] ..... H01R 13/639

[52] U.S. Cl. ..... 439/188; 439/354; 439/490

[58] Field of Search ..... 439/488, 489, 490, 188, 439/354, 353, 350, 357, 509; 200/51.09, 51.10, 51.11

[56] References Cited

U.S. PATENT DOCUMENTS 4,878,853 11/1989 Yamade et al. ..... 439/490 X
4,900,267 2/1990 Nagasaka et al. ..... 439/488 X
5,035,644 7/1991 Nakazato et al. ..... 439/188 X

FOREIGN PATENT DOCUMENTS 920250 1/1973 Canada ..... 439/490

*Primary Examiner*—Larry I. Schwartz

*Assistant Examiner*—J. R. Daulton

*Attorney, Agent, or Firm*—Wigman & Cohen

[57] ABSTRACT

A connector for electrically interconnecting first terminals and second terminals connected respectively to wirings is disclosed. The connector is capable of detecting a fitted condition between the first and second terminals by a fitted-condition detector. The connector includes a first connector element and a second connector element. The first connector element has a connector body. The first terminals are retained by the connector body. The first connector element is fitted in the second connector element, and the second connector element retains the second terminals fitted with respect to the first terminals. A flexible lock arm is provided integrally on the first connector element. A space is defined between the lock arm and the connector body. An engaging portion is formed on the second connector element. The lock arm is engaged with the engaging portion when the first connector element and the second connector element are perfectly fitted in each other. A fitting detecting section is arranged within the space between the connector body and the lock arm of the first connector element and is capable of detecting the fitted condition between said first and second connector elements by the fitted-condition detector.

9 Claims, 4 Drawing Sheets

CONNECTOR AND DETECTOR FOR DETECTING FITTED CONDITION BETWEEN CONNECTOR ELEMENTS

BACKGROUND OF THE INVENTION

The present invention relates to a connector capable of detecting a fitted condition between a male connector element and a female connector element, and to a detector for detecting the fitted condition between the male and female connector elements.

FIGS. 1 and 2 of the accompanying drawings shows a connector 1 proposed in Japanese Utility Model Laid-Open No. SHO 63-225480 in which a semi-fitted condition between male and female connector elements is detected. In FIGS. 1 and 2, the connector 1 comprises a female connector element 3 and a male connector element 7 which is fitted in a fitting hood section 5 formed in the female connector element 3. The fitting hood section 5 of the female connector element 3 has an outer periphery which is integrally formed with a plurality of projections 9. Further, the male connector element 7 is provided with a lock arm 11 whose free end is formed with a plurality of projections 13 identical in shape or configuration with the projections 9 formed on the female connector element 3.

Furthermore, the female connector element 3 has a housing section 15 which is formed with a plurality of terminal accommodating chambers 17. A plurality of male-terminal metal parts 19 are accommodated respectively in the terminal accommodating chambers 17. The male-terminal metal parts 19 have their respective forward ends which project into the fitting hood section 5.

On the other hand, the male connector element 7 has a connector body 21 which is formed with a plurality of terminal accommodating chambers 23. A plurality of female-terminal metal parts 25 are accommodated respectively in the terminal accommodating chambers 23. The male-terminal metal parts 19 and the female-terminal metal parts 25 are connected respectively to ends of wirings 29 and 31 by caulking connection or the like, as shown in FIG. 2.

The female connector element 3 and the male connector element 7 are arranged in a predetermined positional relationship as shown in FIG. 1. The projections 13 on the male connector element 7 fitted in the fitting hood section 5 fall in line with the projections 9 formed on the outer periphery of the fitting hood section 5, in a predetermined positional relationship.

It is detected by judging means 27 (for example, a bar code reader or the like) shown in FIG. 2 whether or not two or more of the projections 9 and 13 are arranged in a predetermined positional relationship, to detect a fitted condition between the male connector element 7 and the female connector element 3. Thus, it is judged whether or not the male connector element 7 and the female connector element 3 are under a semi-fitted condition.

In the female and male connector elements which cooperate with each other to form the connector, however, inevitable backlash at fitting or errors in dimension at manufacturing causes/cause slight backlash to occur under the fitted condition of the male connector element 7 into the fitting hood section 5 of the female connector element 3. For this reason, two or more of the projections 9 and 13 cannot fall in line with each other in the predetermined positional relationship, under the fitted condition of the male connector element 7 into the female connector element 3. If this is detected by the judging means 27, in spite of the fact that the male connector element 7 and the female connector element 3 are perfectly or completely fitted in each other, it is judged that the male and female connector elements 7 and 3 are under a semi-fitted condition. Thus, there is a problem that the fitted condition is erroneously detected.

Moreover, when the judging means 27 detects the projections 9 and 13 falling in line with each other in the predetermined positional relationship, it is required that the judging means 27 is positioned in a predetermined position with respect to the projections 9 and 13. For this reason, it is troublesome or cumbersome to position the judging means 27 with respect to the projections 9 and 13. There is a problem that, depending upon the position of the judging means 27 with respect to the projections 9 and 13, the fitted condition is erroneously detected in spite of the fact that the male connector element 7 is perfectly fitted in the female connector element 3.

SUMMARY OF THE INVENTION

It is therefore an object of the invention to provide a connector and a semi-fitting detector in which, even if backlash occurs under a fitted condition between a male connector element and a female connector element, the fitted condition is not erroneously detected, and positioning of judging means to a detecting position is easy.

According to a first aspect of the invention we provide a connector for electrically connecting first terminals and second terminals connected respectively to wirings, to each other, the connector being capable of detecting a fitted condition between the first and second terminals by a fitted-condition detector, the connector comprising:

a first connector element having a connector body, the first terminals being retained by the connector body;

a second connector element, the first connector element being fitted in the second connector element, the second connector element retaining the second terminals fitted with respect to the first terminals;

a flexible lock arm provided integrally on the first connector element, a space being defined between the flexible lock arm and the connector body;

an engaging portion formed on the second connector element, the lock arm being engaged with the engaging portion when the first connector element and the second connector element are perfectly fitted in each other; and a fitting detecting section arranged within the space and capable of detecting the fitted condition between the first and second connector elements by the fitted-condition detector.

According to a second aspect of the invention we provide a fitted condition detector for detecting a fitted condition between a first connector element and a second connector element of a connector which includes the first connector element having a connector body; the second connector element, the first connector element being fitted in the second connector element; a flexible lock arm provided integrally on the first connector element, a space being defined between the lock arm and the connector body; an engaging portion formed on the second connector element, the engaging portion being engaged with the lock arm when the first connector element and the second connector element are perfectly fitted in each other; and a fitting detecting section arranged within the space and capable of detecting the fitted condition between the first and second connector elements by the fitted-condition detector, the fitted-condition detector comprising:

a gripping section capable of being gripped;

an inserting section connected to the gripping section, the inserting section being capable of being inserted into the space when the lock arm is not deflected, the inserting section being incapable of being inserted into the space when the lock arm is deflected; and detecting means for detecting the fitting detecting section and provided at a forward end of the inserting section.

DETAILED DESCRIPTION OF THE PREFERRED EMBODIMENTS

An embodiment of a connector and an embodiment of a semi-fitting detector according to the invention will be described below.

Figure 1:
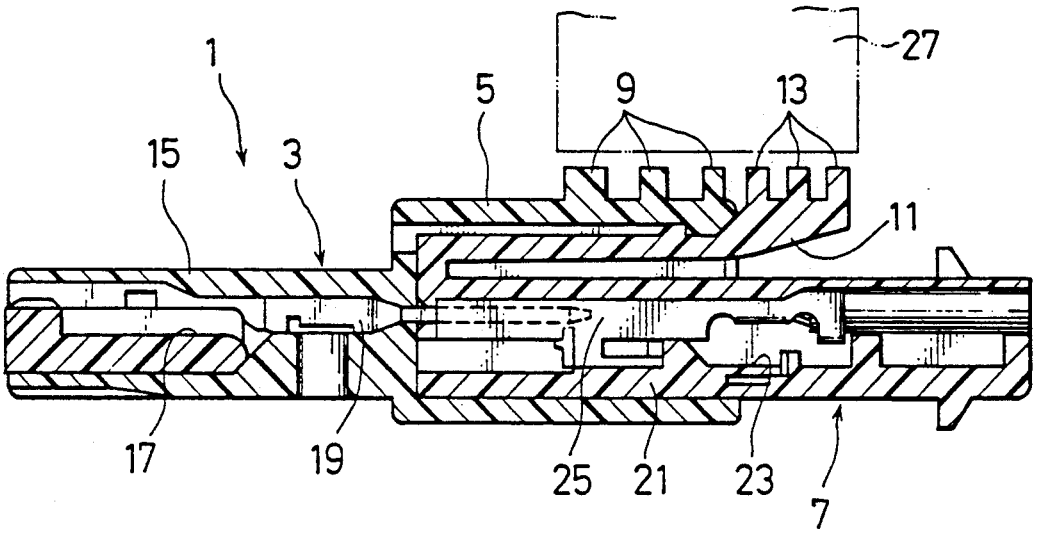
FIG. 1 PRIOR ART
FIG. 1 is a cross-sectional view showing a conventional semi-fitting detected connector.
Figure 2:
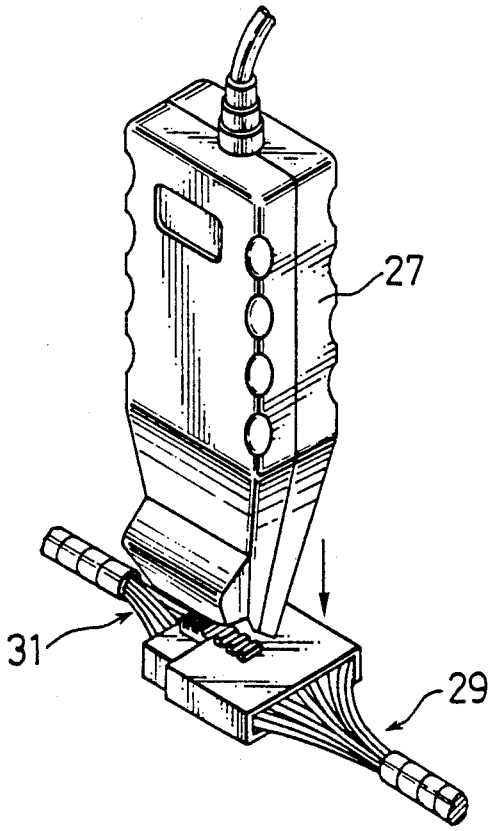
FIG. 2 PRIOR ART
FIG. 2 is a perspective view showing a conventional semi-fitting detector which detects a fitted condition of the conventional semi-fitting detected connector.
Figure 3:
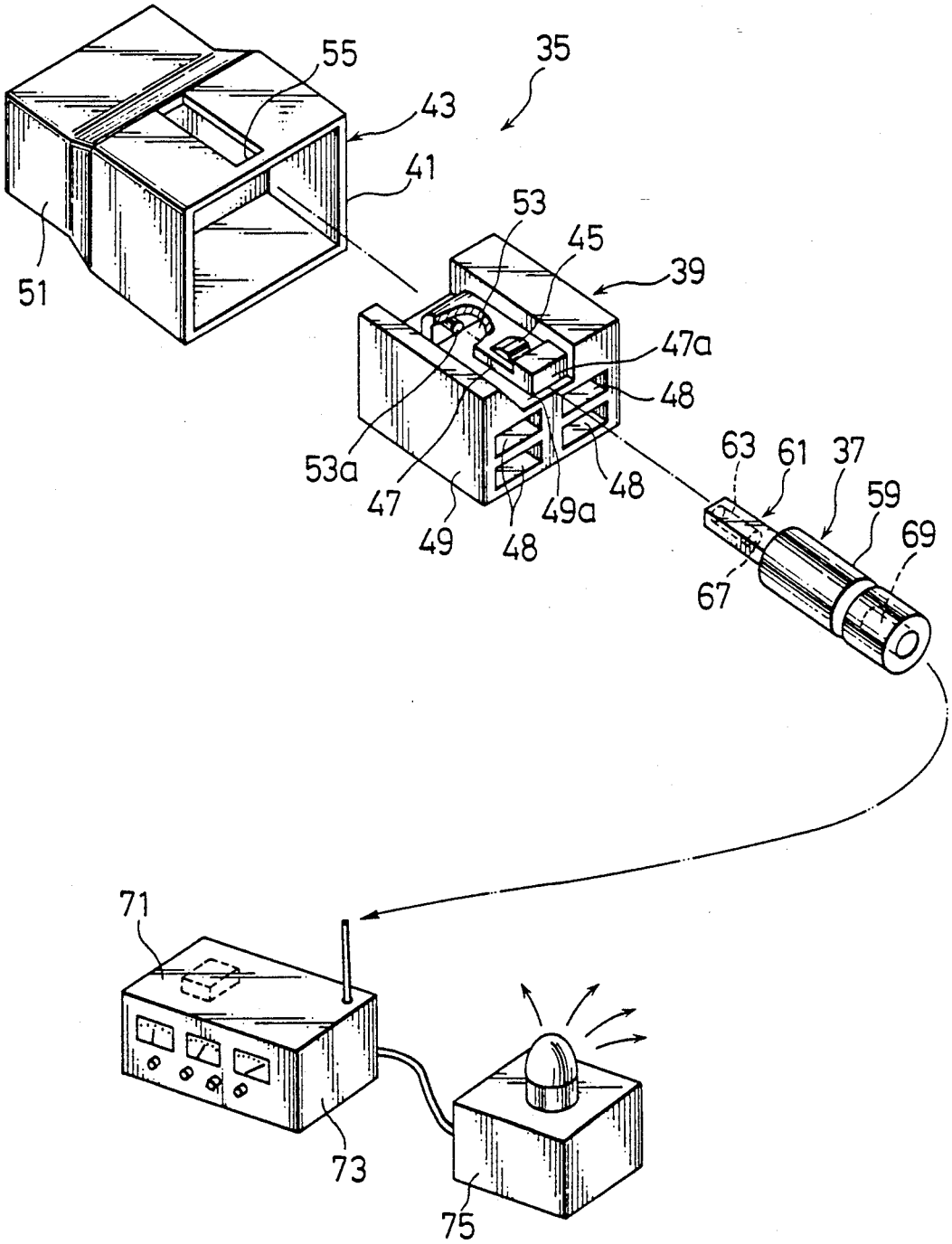
FIG. 3 is a perspective view showing a connector and a semi-fitting detector according to the invention.

FIG. 3 shows a connector 35 and a semi-fitting detector 37 for detecting a semi-fitted condition of the connector 35.

As shown in FIG. 3, the connector 35 comprises a male connector element 39 and a female connector element 43 formed with a fitting hood section 41 into which the male connector element 39 is fitted. The male connector element 39 is formed with a lock arm 47, while the female connector element 43 is formed with an engaging portion 55 which is engaged with a portion to be engaged 45 on the lock arm 47. The lock arm 47 and the engaging portion 55 cooperate with each other to form lock means 46 (refer to FIG. 4A). The lock arm 47 extends from a connector body 49 rearward in a fitting direction.

The connector body 49 of the male connector element 39 is formed with four terminal accommodating chambers 48. Four female-terminal metal parts are accommodated respectively in the four terminal accommodating chambers 48. These female-terminal metal parts are connected in caulking respectivley to ends of a plurality of wirings (not shown).

On the other hand, the female connector element 43 has a housing section 51 which is formed with a plurality of terminal accommodating chambers (not shown). A plurality of male-terminal metal parts are accommodated respectively in the terminal accommodating chambers. The male-terminal metal parts have their respective forward ends which project into the fitting hood section 41. These male-terminal metal parts are connected in caulking respectively to ends of a plurality of wirings (not shown).

A space 53, in which the lock arm 47 can be deflected, is defined between a free end 47*a* of the lock arm 47 and an upper face 49*a* of the connector body 49. A projection 53*a*, serving as a fitting detecting section 57 (refer to FIG. 4B), is formed at a location within the space 53 adjacent to a root of the lock arm 47. The projection 53*a* extends rearwardly in the fitting direction. The fitting detecting section 57 as a forward end which is formed with a tapered portion 57*a*, to facilitate insertion of a forward end of the fitted-condition detector 37 which is inserted into the space 53 through an opening between the free end 47*a* of the lock arm 47 and the upper face 49*a* of the connector body 49.

Figure 5:
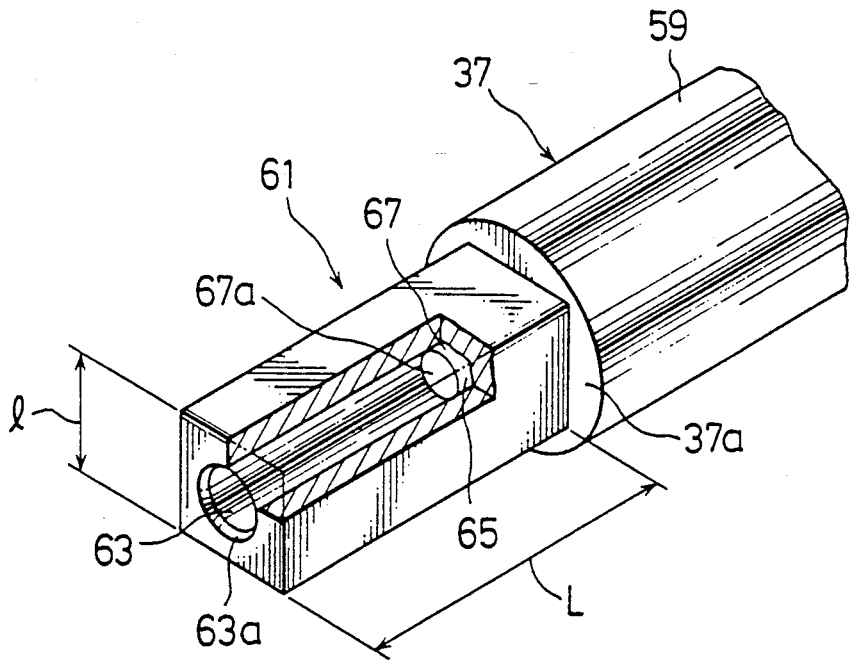
FIG. 5 is a perspective view showing a flexible-space inserting section of the semi-fitting detector.

The fitted-condition detector 37 whose forward end faces toward the fitting detecting section 57 will next be described. As shown in FIG. 5, the fitted-condition detector 37 has a gripping section 59 whose forward end is formed with an inserting section 61. The inserting section 61 is rectangular in cross-sectional shape in a plane extending perpendicularly to a longitudinal direction. The inserting section 61 has a height 1 which is set to a value substantially identical with a height of the space 53 in the lock arm 47. Further, a step 38*a* is formed between the inserting section 61 and the gripping section 59, and the inserting section 61 has a length L which is set to a depth of the space 53. Under a condition that the inserting section 61 is perfectly or completely inserted into the space 53, the step 37*a* is abutted against the free end 47*a* of the lock arm 47. The inserting section 61 has a forward end which is formed therein with a bore 63 opening in the forward end and extending toward the interior of the inserting section 61. The bore 63 is formed into a diameter and a depth into which the projection 53*a* formed at the location adjacent to the root of the lock arm 47 can be fitted. Furthermore, the bore 63 has an opening edge which is formed with a tapered portion 63*a* to facilitate insertion of the projection 53*a* into the bore 63.

Moreover, the bore 63 has the deepest section 65 at which a detecting surface 67*a* of an optical sensor 67, that is detecting means, is located. As shown in FIG. 3, the optical sensor 67 is connected to an oscillating section 69 which is arranged within the gripping section 59, to oscillate a detecting signal by the oscillating section 69.

A receiving section 71, which receives the signal oscillated from the oscillating section 69, is incorporated within a controller 73. The controller 73 notifies an operator by alarm means 75, for example, a buzzer, a lamp or the like, on the basis of the detecting signal oscillated from the oscillating section 69.

A fitted-condition detecting method of detecting the fitted condition of the connector 35 constructed as described above, by the fitted-condition detector 37, will next be described.

Figure 4A:
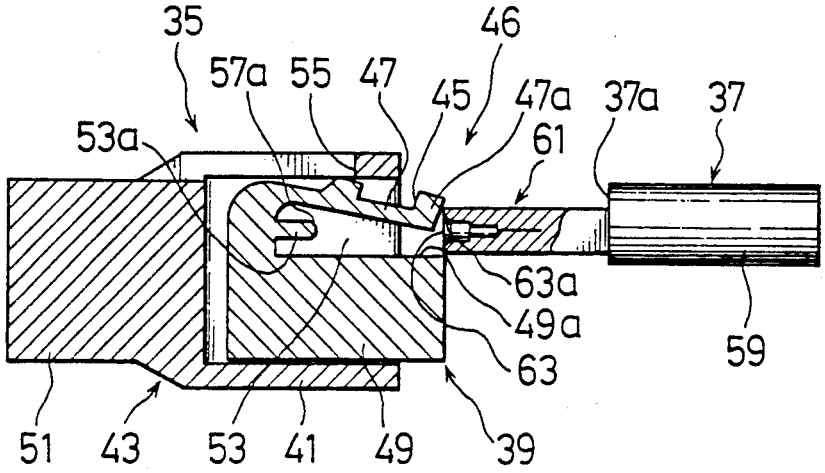
FIG. 4A is a cross-sectional view showing a semi-fitted condition between a male connector element and a female connector element.

As shown in FIG. 4A, in the case where the connector body 49 of the male connector element 39 is inserted part of the way into the fitting hood section 41 of the female connector element 43, the lock arm 47 is under a deflected condition, that is, under a condition that the space 53 is closed. Under this condition, the portion to be engaged 45 cannot be engaged with the engaging portion 55 so that the condition is brought to an incompletely fitted condition. Under this condition, if an attempt is made to insert the inserting section 61 of the fitted-condition detector 37 into the opening defined between the free end 47*a* of the lock arm 47 and the upper face 49*a* of the connector body 49, it is impossible to insert the inserting section 61 into the opening.

For this reason, since it is impossible to insert the projection 53*a* formed at the location adjacent to the root of the lock arm 47 into the bore 63 formed at the forward end of the inserting section 61, the optical sensor 67 cannot detect the projection 53*a*.

Accordingly, it is possible to detect the imperfectly fitted condition between the engaging portion 55 and the lock arm 47. As a result, it is possible to detect the imperfectly fitted condition between the male connector element 39 and the female connector element 43. Further, at this time, since the optical sensor 67 cannot detect the forward end of the projection 53*a*, a signal indicating this imperfectly fitted condition is transmitted to the controller 73 through the oscillating section 69 and the receiving section 71. The controller 73 notifies the operator that the male connector element 39 and the female connector element 43 are under the imperfectly fitted condition, by the alarm means 75.

Figure 4B:
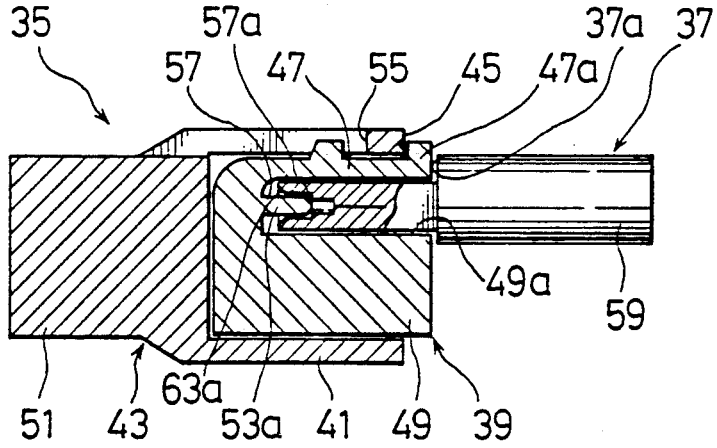
FIG. 4B is a cross-sectional view showing a fitted condition between the male connector elements and the female connector element.

Furthermore, as shown in FIG. 4B, under a condition that the connector body 49 of the male connector element 39 is perfectly fitted in the fitting hood section 41 of the female connector element 43, the portion to be engaged 45 on the lock arm 47 is perfectly engaged with the engaging portion 55. Under this condition, since a gap between the free end 47*a* of the lock arm 47 and the upper face 49*a* of the connector body 49 of the male connector element 39 is open, it is possible to insert the inserting section 61 of the fitted-condition detector 37 into the space 53.

In this manner, the projection 53*a* is inserted into the bore 63, whereby it is possible to easily and accurately position the fitted-condition detector 37.

The inserting section 61 is inserted into the space 53, and the projection 53*a* formed at the location adjacent to the root of the lock arm 47 is inserted into the bore 63. Then, the optical sensor 67 arranged at the deepest portion within the bore 63 detects the forward end of the projection 53*a*. The signal indicating this perfectly fitted condition by detecting the forward end of the projection 53*a* is transmitted to the controller 73 through the oscillating section 69 and the receiving section 71.

Further, even in the case where backlash occurs between the male connector element 39 and the female connector element 43 due to manufacturing errors or the like under the condition that the male connector element 39 and the female connector element 43 are perfectly fitted in each other, the projection 53*a* is inserted into the bore 63, if it is ensured that the inserting section 61 of the imperfect fitting detector 37 is inserted into the space 53. Accordingly, there is no case where the perfectly fitted condition between the male connector element 39 and the female connector element 43 is erroneously detected.

Furthermore, in the case where the lock arm 47 is deflected slightly so that the gap between the lock arm 47 and the upper face 49*a* of the connector body 49 is narrowed, it is impossible to insert the inserting section 61 of the fitted condition detector 37 into the space 53. Accordingly, it is possible to ensure that the imperfectly fitted condition between the male connector element 39 and the female connector element 43 is detected. Thus, there is no case where the imperfect fitted condition between the male connector element 39 and the female connector element 43 is erroneously detected.

In connection with the above, the above-described embodiment has been arranged such that the projection is formed at the location adjacent to the root of the lock arm 47 adjacent to the space 53, and the bore 63 is formed in the forward end of the imperfect fitting detector 37. However, the arrangement may be such that a bore is formed at the root of the lock arm 47, and a projection on the forward end of the semi-fitting detector 37 is formed into a shape capable of being inserted into the bore. Moreover, the arrangement may be such that an optical sensor, for example, is arranged at the forward end of the semi-fitting detector 37.

Further, in the aforesaid embodiment, the optical sensor 65 is directly arranged within the bore 63. However, the invention is not limited to this specific arrangement. That is, an optical fiber has a forward end which may be arranged within the bore 63. Alternatively, detecting means such as a proximity switch, a microswitch or the like may be substituted for the aforementioned optical detecting means.

Furthermore, the bore formed at the forward end of the semi-fitting detector 37 has a part which may be formed into a concave shape opening axially. Moreover, in the above-described embodiment, the bore is formed at the location adjacent to the root of the lock arm 47, and projects from the deepest portion toward the free end of the lock arm 47. However, the invention is not limited to this specific embodiment. A projection may be formed which projects from the upper face of the connector body and which is bent toward the free end of the lock arm 47.

What is claimed is:

1. A connector body for electrically connecting first terminals and second terminals connected respectively to wirings, said connector being capable of detecting a fitted condition between said first and second terminals by a fitted-condition detector, said connector comprising:

a first connector element having a connector body, holding said first terminals;

a second connector element being fitted with respect to said first connector element, holding said second terminals to be fittd with respect to said first terminals;

a flexible lock arm provided integrally on said first connector element, defining a space between said flexible lock arm and said connector body, said space being capable of receiving a fitted-condition detector when said second connector element is completely fitted to said first connector element, said lock arm obstructing insertion of said fitted-condition detector when said second connector element is incompletely fitted to said first connector element;

an engaging portion formed on said second connector element, being engaged with said lock arm when said first connector element and said second connector element are perfectly fitted in each other; and a fitting detecting section of said fitted-condition detector arranged within said space, said completely fitted condition of said second connector element with said first connector element being detected by said fitted-condition detector.

2. A connector according to claim 1, wherein said fitting detecting section includes a projection which is capable of being fitted in said fitted-condition detector.

3. A connector according to claim 1, wherein said lock arm extends from said connector body rearward in a fitting direction of said first connector element to said second connector element, said lock arm slideably engageable with said second connector element, and wherein said fitting detecting section includes a projection which extends from a proximal portion of said lock arm rearward in the fitting direction.

4. A connector for electrically connecting first terminals and second terminals connected respectively to wirings, said connector being capable of detecting a fitted condition between said first and second terminals by a fitted-condition detector, said connector comprising:

a first connector element having a connector body, holding said first terminals;

a second connector element being fitted with respect to said first connector element, holding said second terminals to be fitted with respect to said first terminals;

a flexible lock arm provided integrally on said first connector element, having a space defined between said flexible lock arm and said connector body;

an engaging portion formed on said second connector element, being engaged with said lock arm when said first connector element and said second connector element are perfectly fitted in each other;

a fitting detecting section arranged within said space, being detected by said fitted-condition detector, wherein said fitting detecting section includes a bore, in which said fitted-condition detector is capable of being fitted.

5. A fitted condition detector for detecting a fitted condition between a first connector element and a second connector element of a connector which includes said first connector element having a connector body; said second connector element being fitted with respect to said first connector; a flexible lock arm provided integrally on said first connector element, having a space defined between said lock arm and said connector body; an engaging portion formed on said second connector element, being engaged with said lock arm when said first connector element and said second connector element are perfectly fitted in each other; and a fitting detecting section arranged within said space, being detected by said fitted-condition detector, said fitted-condition detector comprising:

a gripping section capable of being gripped;

an inserting section connected to said gripping section, being capable of being inserted into said space when said lock arm is not deflected, being incapable of being inserted into said space when said lock arm is deflected; and detecting means for detecting said fitting detecting section, being provided at a forward end of said inserting section.

6. A fitted condition detector according to claim 5, wherein said inserting section includes a bore, in which said fitting detecting section is fitted.

7. A fitted condition detector according to claim 5, wherein said inserting section includes a projection, which is capable of being fitted in said fitting detecting section.

8. A fitted condition detector according to claim 5, wherein said detecting means includes an optical sensor.

9. A fitted condition detector according to claim 8, further comprising:

an oscillating section for oscillating a signal from said optical sensor as a detecting signal;

a receiving section receiving the detecting signal from said oscillating section; and alarm means for generating an alarm on the basis of the detecting signal from said receiving section.

* * * * *